United States Patent [19]

Foster

[11] 4,206,855

[45] Jun. 10, 1980

[54] STORAGE BIN WITH MULTIPLE DISCHARGE OPENINGS FOR PARTICULATE MATERIAL

[75] Inventor: Charles R. Foster, Douglasville, Ga.

[73] Assignee: Owens-Corning Fiberglas Corporation, Toledo, Ohio

[21] Appl. No.: 916,017

[22] Filed: Jun. 15, 1978

[51] Int. Cl.[2] ..... B67D 3/00

[52] U.S. Cl. ..... 222/482; 222/488; 222/564

[58] Field of Search ..... 222/489, 488, 564, 478, 222/479, 482, 484, 485, 195, 185; 366/101, 137

[56] References Cited

U.S. PATENT DOCUMENTS

| | | | |
|---|---|---|---|
| 2,718,339 | 9/1955 | Pankratz | 222/485 |
| 2,805,802 | 9/1957 | Strong | 222/564 |
| 3,106,385 | 10/1963 | Arthur et al. | 366/101 X |
| 3,275,303 | 9/1966 | Goins | 366/137 |

*Primary Examiner*—Stanley H. Tollberg

*Attorney, Agent, or Firm*—Ronald C. Hudgens; Allen D. Gutchess, Jr.; Charles F. Schroeder

[57] ABSTRACT

A storage bin with multiple discharge openings is provided for particulate material. A bottom wall of the bin has a plurality of discharge openings, preferably an even number, with half of them spaced closer to the center line of the bin than the other half. More specifically, the outer half are positioned adjacent the side wall of the bin and the inner half are spaced from the center line by three-fourths of the distance from the center line to the side wall. Each half is also equally peripherally spaced around the bin. The bottom wall preferably is of inverted conical shape and can have a cone centrally positioned thereon, with the periphery of the cone located inwardly from the inner discharge openings. Portions of the cone periphery can be spaced from the bottom wall to enable particulate material to flow down below the cone to a central discharge duct having a valve which is opened from time-to-time.

9 Claims, 3 Drawing Figures

STORAGE BIN WITH MULTIPLE DISCHARGE OPENINGS FOR PARTICULATE MATERIAL

This invention relates to a storage bin with multiple discharge openings for particulate material.

Storage bins commonly have bottom walls of inverted conical shape with a central discharge duct. Such bins often hold particulate material which has a range of sizes from fine to coarse. It has been found that with storage bins of this type, the coarse material tends to move directly through the bin to the discharge duct. The fine material tends to collect around the side wall of the bin. This fine material tends to remain until the level in the bin falls below one-third full at which time it will discharge. Hence, the coarse material dominates in the early discharge and the fine material later.

In accordance with the invention, a plurality of discharge openings are provided in the bottom wall of a storage bin to substantially eliminate segregation of the particulate material. Preferably there are an even number of the discharge openings and preferably at least four of them. The outer openings are positioned adjacent the side wall of the bin and the inner openings are spaced from the center line of the bin a distance from five-eighths to seven-eighths the distance from the center line of the bin to the periphery. The outer openings are preferably equally spaced around the bin and so are the inner openings, and preferably all are equally spaced so that the included angles between adjacent radial lines drawn from the center line of the bin through centers of the openings are also equal.

The bottom wall of the bin can be of inverted conical shape and can have a metal cone centrally supported thereon. The cone has a peripheral edge spaced slightly inwardly from the inner discharge openings to help direct the central particulate material toward these openings. The metal cone is not essential because the particulate material will form its own cone, but the metal cone reduces friction of the material during discharging from the bin. When the cone is used, portions of its periphery can be spaced from the bottom wall so that particulate material may flow under the metal cone. The storage bin can then have a central discharge duct with a valve which can be opened from time-to-time as an alternate discharge.

It is, therefore, a principal object of the invention to provide a storage bin for particulate material with multiple discharge openings.

Another object of the invention is to provide a storage bin which reduces the tendency for particulate material to segregate.

Many other objects and advantages of the invention will be apparent from the following detailed description of a preferred embodiment thereof, reference being made to the accompanying drawings, in which.

Figure 2:
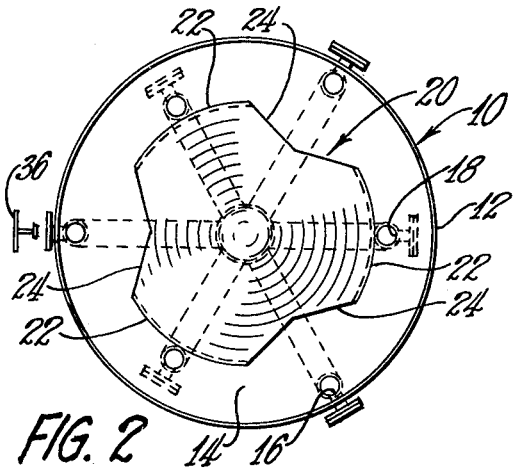
FIG. 2 is a plan view of the storage bin of FIG. 1.
Figure 1:
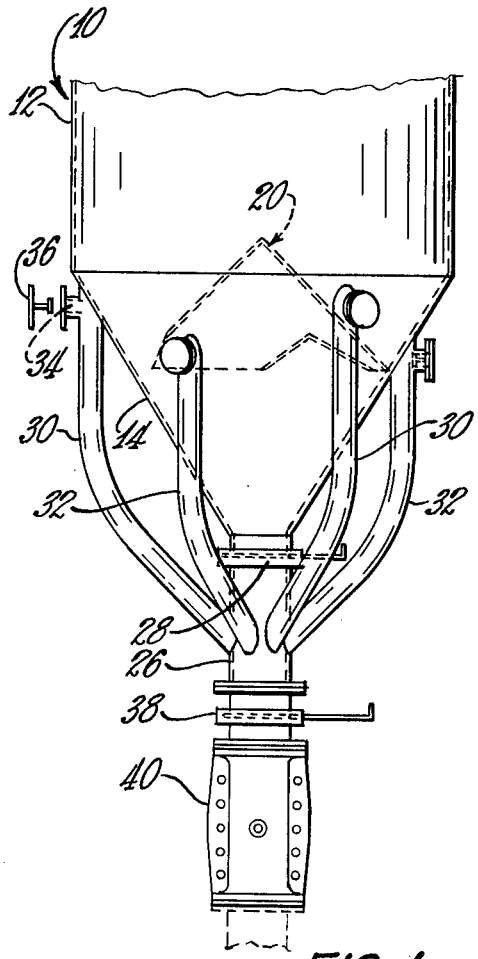
FIG. 1 is a fragmentary view in elevation of a storage bin embodying the invention.
Figure 3:
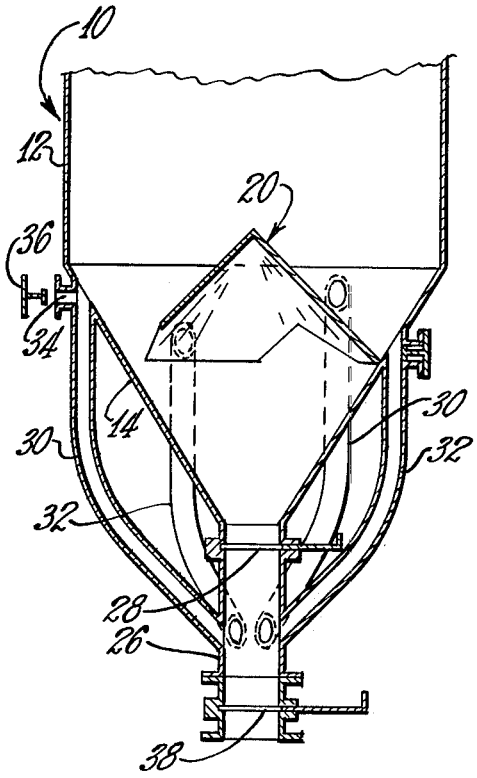
FIG. 3 is a fragmentary view in vertical cross section taken through the storage bin of FIGS. 1 and 2.

Referring to the drawings, a storage bin embodying the invention is indicated at 10 and includes a side wall 12 which can be circular, as shown, or rectangular, in either case having a vertical center line (not indicated). The bin has a bottom wall 14 which is shown as being an inverted cone in shape. The bin has a plurality of discharge openings therein according to the invention, with three outer openings 16 and with three inner openings 18. The number of total openings preferably is an even one, with at least four openings preferably being employed.

The outer openings 16 are located adjacent the side wall while the inner openings 18 are spaced from the center line of the bin by a distance from five-eighths to seven-eighths, and preferably three-fourths, of the distance from the center line to the side wall of the bin. The outer openings 16 are equally spaced around the bin and the inner openings 18 are also equally spaced around the bin. Preferably, adjacent radial lines from the center line of the bin through the centers of the discharge openings form equal included angles. The size of the discharge openings 16 and 18 vary widely, depending upon the material being held and on the rate of discharge desired. The discharge must occur in a choke-fed condition instead of a streamlined or fluidized flow condition. If the latter occurs, the finer material will tend to settle to the bottom while the coarser material comes to the top.

In a preferred form, an upright metal cone 20 is supported on the bottom wall 14. This helps direct the central material in the bin toward the inner discharge openings 18. However, without the metal cone 20, the particulate material will form its own cone but will result in somewhat higher frictional forces. A peripheral edge 22 of the cone 20 preferably is located just inwardly of the discharge openings 18 to more effectively direct the particulate material. In one form, as shown, the peripheral edge 22 has portions 24 which are located between the inner openings 18 and spaced slightly from the bottom wall 14 to enable the particulate material to be directed downwardly under the cone 20. As shown, the portions 24 are of shallow, inverted V-shaped configuration and extend about one-half the peripheral distance between the adjacent inner openings 18.

When the cone 20 with the spaced peripheral portions 24 is employed, a central discharge duct 26 is located at the apex of the inverted conical bottom wall 14. The duct 26 has a slide valve 28 therein which can be opened to discharge the particulate material in the conventional manner.

Outer discharge ducts 30 communicate with the center discharge duct 26 under the valve 28. Similarly, inner discharge ducts 32 communicate with the inner discharge openings 18 and with the central discharge duct 26 under the valve 28. Each of the discharge ducts 32 have a clean-out opening 34 with a clean-out plug 36.

To control overall flow of the discharged material below the discharge ducts 30 and 32, a slide valve 38 and a boot valve 40 are located in the central discharge duct 26.

Various modifications of the above-described embodiment of the invention will be apparent to those skilled in the art and it is to be understood that such modifications can be made without departing from the scope of the invention if they are within the spirit and the tenor of the accompanying claims.

I claim:

1. A receptacle for holding and discharging particulate material, said receptacle comprising upright side wall means defining a space having a center line, a bottom wall of inverted conical shape extending across said side wall means and enclosing the lower portion of same, a plurality of discharge openings in said bottom wall and including at least one opening near the side wall means and at least a second opening spaced from said center line by a distance from five-eights to seven-eights of the distance from the center line to said side wall means, an upright conical wall supported on said bottom wall and having peripheral portions located inwardly of the second discharge opening, said conical wall having peripheral edge portions spaced from said bottom wall, a central discharge duct communicating with the lowest portion of said bottom wall, a normally-closed valve located in said central discharge duct, and a plurality of discharge lines connecting said discharge openings and said central discharge line below said valve.

2. A receptacle for holding and discharging particulate material, said receptacle comprising an upright side wall, a bottom extending across said side wall and closing the lower end portion of said side wall, a plurality of discharge openings in said bottom wall and including a first set of said discharge openings located near said side wall and equally spaced around said bottom wall and a second set of said discharge openings located farther from said side wall than said first set and equally spaced around said bottom wall, and a plurality of discharge lines connecting said discharge openings to a discharge duct with said connections being below said bottom wall.

3. A receptacle as recited in claim 2, wherein said second set of discharge openings is spaced from a center line of said receptacle by a distance which is five eighths to seven eighths of the distance from said center line to said side wall.

4. A receptacle as recited in claim 2, wherein said bottom wall has an inverted conical shape, and further comprising an upright conical wall which is supported on said bottom wall and has a peripheral portion located inwardly of said second set of discharge openings.

5. A receptacle as recited in claim 4, wherein said conical wall has a peripheral portion spaced from said bottom wall.

6. A receptacle as recited in claim 2, wherein the lowest portion of said bottom wall has an aperture that communicates with said duct, and further comprising a normally-closed valve located in said duct above said connection of said plurality of discharge lines to said duct.

7. A receptacle for holding and discharging particulate material, said receptacle comprising upright side wall means defining a space having a center line, a bottom wall extending across said side wall means and enclosing the lower portion of same, said bottom wall being of inverted conical shape, a plurality of discharge openings in said bottom wall and including at least one opening near the side wall means and at least a second opening spaced farther from said side wall means, a central discharge duct communicating with the lowest portion of said bottom wall, a normally-closed valve located in said central discharge duct, and a plurality of discharge lines connecting said discharge openings and said central discharge duct below said valve.

8. A receptacle according to claim 7 characterized by an additional valve in said central duct below said discharge lines.

9. A receptacle as recited in claim 2, wherein there is an even number of said plurality of discharge openings with one half of said discharge openings comprising said first set and the other half of said discharge openings comprising said second set.

* * * * *